United States Patent [19]

Nagatugi et al.

[11] 4,040,879

[45] Aug. 9, 1977

[54] PROCESS FOR PREPARING A MATCH HEAD COMPOSITION CONTAINING PARTICULATE NITROCELLULOSE AND NO SULFUR

[75] Inventors: Shuzo Nagatugi, Kobe; Akira Miyagawa; Suguru Fukuoka, both of Himeji, all of Japan

[73] Assignee: Daicel Ltd., Osaka, Japan

[21] Appl. No.: 654,346

[22] Filed: Feb. 2, 1976

[51] Int. Cl.[2] ..... C06B 45/08

[52] U.S. Cl. ..... 149/18; 144/42; 149/19.1; 149/19.91; 149/79; 149/109.6

[58] Field of Search ..... 149/18, 19.8, 31, 79, 149/19.1, 19.92, 109.6; 44/42, 47

[56] References Cited

U.S. PATENT DOCUMENTS

| | | | |
|---|---|---|---|
| 2,015,383 | 9/1935 | Konig et al. | 44/42 X |
| 2,062,191 | 11/1936 | Pullen | 44/47 |
| 3,272,604 | 9/1966 | Tigrett et al. | 44/42 |
| 3,650,712 | 3/1972 | Martin et al. | 44/42 |
| 3,775,198 | 11/1973 | Hijikata | 149/18 |

*Primary Examiner*—Edward A. Miller

*Attorney, Agent, or Firm*—Blanchard, Flynn, Thiel, Boutell & Tanis

[57] ABSTRACT

A match head composition is prepared by mixing and kneading the component agents of the composition with glue and water, characterized in that wetted powdery cellulose nitrate containing more than 20 percent of water and having grain size of less than 840 microns is mixed in the composition in an amount not more than 10 weight percent on dry weight standard.

4 Claims, No Drawings

PROCESS FOR PREPARING A MATCH HEAD COMPOSITION CONTAINING PARTICULATE NITROCELLULOSE AND NO SULFUR

BACKGROUND OF INVENTION

1. FIELD OF INVENTION

This invention relates to a method of producing a match head composition and the resulting composition.

2. PRIOR ART OF INVENTION

Generally, matches are produced by preparing a gluey composition by mixing and kneading an igniting agent or agents such as potassium chlorate, a combustion agent or agents such as sulfur, and other ingredients such as glass powder, diatomaceous earth, boric acid powder, pigment, etc., with a gluing agent and water, and attaching this composition to the tips of splints, followed by drying.

However, because sulfur is used as the combustion agent in the composition, the match, when lighted, produces sulfurous acid gas and gives off an offensive smell. Also, when it is desired to make a white-colored match head, the color of sulfur proves to be an impediment to obtaining of a vivid color. Therefore, attempts are being made to replace sulfur with other kinds of combustion agents, and some succcessful results are reported.

SUMMARY OF INVENTION

The present inventors have discovered as a result of extensive studies that it is possible to dispense with sulfur and pine resin and to also reduce the content of potassium chlorate (an igniting agent) by blending fine wet powdery cellulose nitrate with grain size of less than 840 microns (that is, passing the 20-mesh screen) and water content of more than 20% in the composition in an amount not exceeding 10 weight% on dry weight standard.

Cellulose nitrate generally available on the market is in the form of paper sheet or cotton wetted with an organic solvent such as alcohol. Some attempts have been made in the past to use this substance in a match head composition, but they were not successful commerically because of the extreme heterogeneity of the composition resulting from the use of such substance and degeneration of gelation caused by mixing of the organic solvent.

Having an eye to cellulose nitrate which is produced in an aqueous medium, the present inventors have obtained powdery cellulose nitrate and repeated experiments to find out the fact that the use of fine-powdery cellulose nitrate, which has passed the 20-mesh sieve, that is, has the grain size of less than 840 microns, can replace sulfur with no need of changing the conventional match manufacturing process or conditions.

This finely powdered cellulose nitrate, as compared with polyethylene or starch heretofore proposed as a substitute for sulfur, has better combustibility at the time of ignition, so that it eliminates need of using any supplementary combustion agent such as pine resin and even allows reduction of the amount of potassium chlorate used in the composition. Further, the match manufactured according to the method of the present invention has a higher ignition point than the conventional matches to ensure higher safety. Also, since no pine resin is blended therein, generation of soot is reduced. Moverover, because cellulose nitrate is a substance which is advantageously used as a paint ingredient, it proves helpful in producing a vivid and clear color when manufacturing colored matches.

If the water content in the cellulose nitrate used in the present invention is less than 20%, the danger of causing scattering of the powdery particles increases, while if the grain size of cellulose nitrate powders exceeds 840 microns, interlocking of fibers is promoted too much and this impairs its compatibility with the ingredients of the composition, so the cellulose nitrate powders used in the present invention should be as fine as possible. The blending rate of cellulose nitrate in the composition needn't exceed 10 weight%; the said object of the invention can be well accomplished at a rate slightly smaller than the rate at which sulfur is usually blended in conventional compositions.

Generally, the match head composition to be mixed with wetted powdery cellulose nitrate comprises, as primary ingredients, an igniting agent, a combustion agent, a controlling agent, a binder and, optionally coloring matter. As the igniting agent, potassium chlorate is used in the about half of an amount of the composition and potassium bichromate or manganese dioxide can be used therewith. As the combustion agent, rosin in used, but sulfur is not used in accordance with this invention. As the controlling agent, there can be used glass powder, mica powder, talc, diatomaceous earth, and colloidal clay primarily comprising watercontaining aluminium silicate. As the binder, glue or gelatin is generally used.

The following is an embodiment of the present invention.

EXAMPLE

A match head composition was produced according to a common method by blending the following substances at the specified rates respectively.

Potassium chlorate: 45 weight%
Glass powder: 23 weight%
White carbon: 3.5 weight%
Diatomaceous earth: 5.8 weight%
Dextrin: 2.3 weight%
Boric acid: 0.7 weight%
Pigment 1.2 weight%
Gelatin: 12.7 weight%
Cellulose nitrate: 3.5 weight%
(average grain size: 246 microns, moisture: 40%)

The composition could be ignited just as well as normal matches, giving no sulfur smell or other irritating odor while producing no soot. The surface of the composition had good gloss and bright color.

What is claimed is:

1. In a method for preparing a match head composition which comprises blending a mixture consisting essentially of potassium chlorate as an igniting agent, a combustion controlling agent selected from the group consisting of glass powder, mica powder, talc, diatomaceous earth, colloidal clay, boric acid and mixtures thereof, and a binder selected from the group consisting of glue and gelatin, the improvement which comprises: blending in said match head composition as a combustion agent, an effective amount, but not more than 10 weight percent (dry basis), of cellulose nitrate particles having a particle size of less than 840 microns and containing more than 20 weight percent of water, said match head composition being free of sulfur and being free of organic solvent.

2. A method as claimed in claim 1 which said binder is gelatin.

3. A match head composition prepared by the method of claim 1.

4. A match head composition prepared by the method of claim 2.

* * * * *